US008099869B2

(12) United States Patent
Hess

(10) Patent No.: US 8,099,869 B2
(45) Date of Patent: Jan. 24, 2012

(54) DEVICE AND METHOD FOR SEVERING A BEAD OF ADHESIVE OF A MOTOR VEHICLE WINDOW PANE

(75) Inventor: Matthias Hess, Filderstadt (DE)

(73) Assignee: C. & E. Fein GmbH (DE)

( * ) Notice: Subject to any disclaimer, the term of this patent is extended or adjusted under 35 U.S.C. 154(b) by 761 days.

(21) Appl. No.: 11/686,100

(22) Filed: Mar. 14, 2007

(65) Prior Publication Data

US 2007/0214649 A1 Sep. 20, 2007

(30) Foreign Application Priority Data

Mar. 14, 2006 (DE) ..... 10 2006 013 417

(51) Int. Cl.
*B26B 27/00* (2006.01)

(52) U.S. Cl. ..... 30/116; 30/296.1; 30/379.5

(58) Field of Classification Search ..... 30/116, 30/296.1, 314, 317, 372, 379, 379.5
See application file for complete search history.

(56) References Cited

U.S. PATENT DOCUMENTS

| | | | | |
|---|---|---|---|---|
| 3,087,519 | A * | 4/1963 | McCarty et al. | 30/376 |
| 3,867,931 | A * | 2/1975 | Babka | 602/9 |
| 4,041,941 | A * | 8/1977 | Driver | 602/9 |
| 4,227,517 | A * | 10/1980 | Aguiar | 602/9 |
| 4,278,214 | A * | 7/1981 | Caldwell | 242/390.8 |
| 4,819,531 | A * | 4/1989 | Lawhon | 83/56 |
| 4,980,976 | A | 1/1991 | Junginger et al. | 30/272.1 |
| 4,995,153 | A | 2/1991 | Asbery | 30/116 |
| 5,622,093 | A * | 4/1997 | Hutchins | 83/13 |
| 6,591,502 | B1 * | 7/2003 | Gmeilbauer | 30/116 |
| 6,616,800 | B2 * | 9/2003 | Eriksson | 156/344 |
| 2003/0217471 | A1 | 11/2003 | Huang | 30/312 |
| 2006/0117573 | A1 * | 6/2006 | Jensen et al. | 30/286 |

FOREIGN PATENT DOCUMENTS

| | | | |
|---|---|---|---|
| CN | 1225890 | A | 8/1999 |
| DE | 32 15 892 | | 11/1983 |
| DE | 34 09 903 | | 10/1984 |
| DE | 39 33 332 | | 4/1991 |
| DE | 40 12 207 | | 10/1991 |
| DE | 297 11 291 | | 10/1997 |
| EP | 0 093 283 | | 11/1983 |
| EP | 0950631 | A1 | 10/1999 |
| FR | 2765130 | A3 | 12/1998 |
| GB | 2 375 730 | | 11/2002 |
| WO | WO 98/58779 | | 12/1998 |
| WO | WO 2004/103748 | | 12/2004 |

OTHER PUBLICATIONS

European Search Report, Jun. 20, 2007, 6 pages.

* cited by examiner

*Primary Examiner* — Edward Landrum
(74) *Attorney, Agent, or Firm* — St. Onge Steward Johnston & Reens LLC

(57) ABSTRACT

A device and a method are disclosed for severing a bead of adhesive of a motor vehicle window pane. A cutting wire is firstly introduced into a gap between the window pane and the body flange, the cutting wire then being guided around the bead of adhesive, one first end of said cutting wire preferably being fixed outside the vehicle, preferably to the windshield wiper shaft, the second end of the cutting wire being inserted through the bead of adhesive and fixed to a winding device, and the bead of adhesive is severed by means of the cutting wire by reeling in the cutting wire with the aid of the winding device.

13 Claims, 2 Drawing Sheets

DEVICE AND METHOD FOR SEVERING A BEAD OF ADHESIVE OF A MOTOR VEHICLE WINDOW PANE

CROSS-REFERENCE TO RELATED APPLICATIONS

The present application claims priority of German patent application No. 10 2006 013 417.6 filed on Mar. 14, 2006, the content of which is incorporated herein by reference.

FIELD OF THE INVENTION

The invention relates to a device for severing a bead of adhesive of a motor vehicle window pane, in particular of a windshield.

BACKGROUND OF THE INVENTION

In modern motor vehicles, the windshields are fixedly joined to a perimeter body flange by a bead of adhesive made of a polyurethane adhesive or some other suitable adhesive. The bead of adhesive consists of such a strong adhesive that, in combination with the windshield, even the mechanical stability of the vehicle is augmented. It is self-evident, therefore, that severing the adhesive is relatively complicated due to its high strength and toughness.

Since windshields must frequently be replaced because of stone chipping or other types of damage, it is necessary to provide a suitable device and/or a suitable method for removing the glass pane of the windshield.

In many cases, a cutting knife of U-shaped cross-section, by means of which the bead of adhesive is successively severed, has been used for this purpose (see U.S. Pat. No. 4,980,976).

Although such a device and such a method have enabled the bead of adhesive of a windshield to be severed in a satisfactory manner, the gap between the windshield and the body flange has become increasingly narrow in recent years. In many cases, it is no longer possible to use such cutting knives, which are used in combination with an oscillatory drive, in order to sever the bead of adhesive.

Numerous other methods and devices are known for severing the bead of adhesive with the aid of a cutting wire.

The bead of adhesive can be severed, for example, with the aid of a cutting wire fitted with two handles (see U.S. Pat. Nos. 4,995,153 and 2003/0217471 A1).

The specific disadvantage of such a method is that two persons are always needed to sever the bead of adhesive. One person must operate a handle inside the vehicle and one person a handle outside the vehicle. It is also obvious that such a manner of working requires a considerable amount of time and is very tiring on account of the effort involved.

A device and method for severing the bead of adhesive with the aid of a cutting wire, with only one person being needed to sever the bead, is known from U.S. Pat. No. 6,591,502 B1. A suction cup to which a cutting wire is elastically fixed with the aid of a spring is placed onto the windshield. The cutting wire is pulled to the outside using a handle in order to sever the bead bit by bit. The force applied is reduced released after each pull, with the result that the cutting wire is retracted under the force of the compressed spring.

This has the advantage that the severing process can be carried out by only one person. However, a considerable amount of time and energy is still required. A similar assessment can be made of the windshield removal system known from U.S. Pat. No. 5,622,093. Here, too, a suction cup assembly is placed onto the windshield, a cutting wire being fixed to the suction cup via a spring that has a handle at its outer end. The spring is attached to a swivel head that is bidirectionally rotatable about 360° in approximately the same plane as the windshield. In this case also, the cutting wire is pulled with the aid of the handle and alternately retracted under the effect of the spring and the swivel head. This method is likewise relatively time-consuming and tiring for the worker.

From DE 32 15 892 A1 a device for severing a bead of adhesive using a winding device placed inside the vehicle into which the cutting wire is reeled in is known.

However, still considerable skill of the worker is needed to effect severing of the bead when using such a device.

SUMMARY OF THE INVENTION

It is a first object of the present invention to disclose an improved device for severing a bead of adhesive provided between a motor vehicle window pane and the body of the vehicle in a relatively simple manner, saving as much time and effort as possible.

It is a second object of the present invention to disclose a device for severing a bead of adhesive provided between a motor vehicle window pane and the body of the vehicle that is reliable and avoids damage to the car body during cutting out the window pane.

These and other objects of the invention are accomplished according to the invention by a device for severing the bead of adhesive on a motor vehicle window pane, in particular a windshield, said device comprising a cutting wire and a winding device for reeling in the cutting wire.

According to the invention, the bead of adhesive can be severed bit by bit using the winding device, obviating the need for a continuous back-and-forth cutting motion. Instead, the reeling motion can be used to sever the bead of adhesive bit by bit with the aid of the cutting wire.

The term "cutting wire" is understood in this application to mean any wire or any cord that is essentially suitable for severing the bead of adhesive of a windshield. This means that the cutting wire must be sufficiently tear resistant and pliable, and must usually be provided with a suitable coating or suitable surface features in the form of toothed projections in order to support the cutting process. However, it is obvious that the term "cutting wire" can also refer to suitable plastic cords or threads, or the like.

The problem addressed by the invention is further solved by a method for severing a bead of adhesive of a motor vehicle window pane, in particular of a windshield, by means of which bead of adhesive the motor vehicle window pane is bonded to a body flange, said method comprising the following steps:

- introducing a cutting wire into a gap between the window pane and the body flange;
- guiding the cutting wire around the bead of adhesive;
- fixing a first end of the cutting wire;
- inserting a second end of the cutting wire through the bead of adhesive;
- fixing the second end of the cutting wire to a winding device and
- severing the bead of adhesive by means of the cutting wire by reeling in the cutting wire with the aid of the winding device.

In this way, the bead of adhesive can be successively severed in a simple manner with the aid of the cuffing wire. The force required is applied with the aid of the winding device. The winding device can essentially be mechanically driven, but is preferably driven by a motor. In this way, the bead of adhesive can be successively severed with relatively little force being required.

The first end of the cutting wire is preferably fixed to the outside of the vehicle, for example to a windshield wiper shaft, whereas the winding device is deployed on the opposite side, on the inside of the vehicle.

There are sufficient places on the outside of the vehicle where the first end of the cutting wire can be fixed, whereas this would normally be more complicated on the inside of the vehicle.

The windshield wiper shaft, especially, is usually suitable for fixing one end of the cutting wire. The other end is inserted through the bead of adhesive and fixed to the winding device.

By operating the winding device, the cutting wire can be successively reeled onto the winding device, as a result of which the cutting wire is successively pulled through the bead of adhesive.

In one advantageous development of the invention, the winding device is supported on the vehicle body while reeling in the cutting wire.

To this end, the winding device advantageously has a support with which the winding device can preferably be supported on the inside of the vehicle.

By this means, the torque reaction does not need to be manually absorbed, but can be absorbed by supporting the winding device on the vehicle. This enables work to be carried out in a particularly simple, energy-saving and fast manner.

The support also serves to protect fitted parts such as airbags, the dashboard, the roof lining, interior lining, etc. against damage.

The support is preferably fixed to the winding device, thus resulting in simple handling.

In addition, the winding device is preferably driven by a motor, thus enabling work to be carried out in an energy-saving manner.

The cutting wire is preferably wound at a speed of 1 to 20 m/min, preferably of 3 to 12 m/min.

It has been found that particularly good cutting results can be achieved with such a cutting speed, without excessive forces being produced.

According to another configuration of the invention, a control unit is provided for controlling the speed at which the cutting wire is reeled in.

In this way, the winding speed can be optimally adjusted by means of a conventional, infinitely variable speed control.

The winding device used in the invention preferably comprises a slip clutch.

This has the advantage of preventing possible risks of injury resulting from overloading due to the cutting wire jamming, for example, and of preventing tearing of the cutting wire and other problems.

It is preferable that the support is replaceably fixed to the winding device.

This means that different supports adapted to the respective interior of the vehicle can be used. In this way, it is possible for the winding device to be optimally supported on the inside of the vehicle.

In a preferred development of the invention, a suitable fixing means is provided for fixing the cutting wire to the outside of the vehicle. This fixing means can be a clamp or clip, for example, that can be used to clamp the cutting wire preferably to the wiper driveshaft of the vehicle.

In a preferred development of the invention, the winding device has a reel for reeling in the cutting wire.

It is preferable that the reel is externally encapsulated so as to be safe to touch.

This avoids any risk of injury by the cutting wire.

In addition, the winding device preferably has a guide for guiding the cutting wire to the reel.

This ensures that, during the winding operation, the cutting wire is neatly guided and that the cutting wire is neatly wound.

According to another configuration of the invention, the support can be pivoted relative to the winding device and locked in place, for example by being snapped into various angular positions.

This results in even greater variability during the severing and removal process.

It is self-evident that the features of the invention as mentioned above and to be explained below can be applied not only in the combination specified in each case, but also in other combinations or in isolation, without departing from the scope of the invention.

BRIEF DESCRIPTION OF THE DRAWINGS

Additional features and advantages of the invention derive from the following description of a preferred embodiment with reference to the drawings, in which.

DETAILED DESCRIPTION OF THE INVENTION

Figure 1:
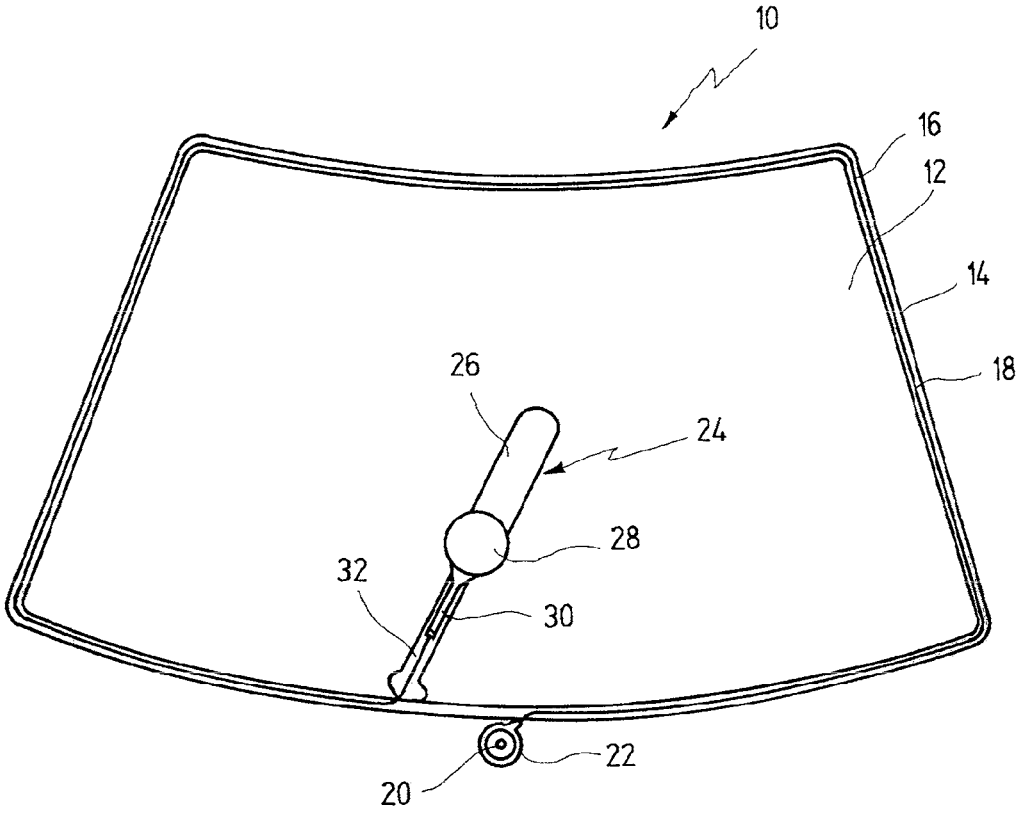
FIG. 1 shows a motor vehicle window pane, viewed from the outside, with a device according to the invention in deployment.

In FIG. 1, a device according to the invention is labeled in its entirety with reference numeral 10.

Figure 2:
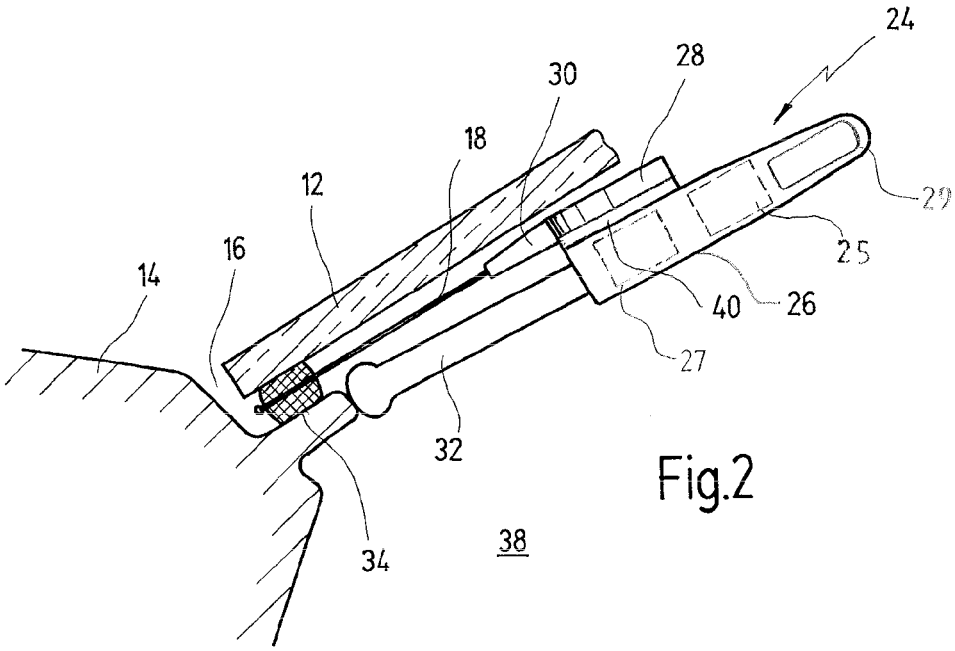
FIG. 2 illustrates an enlarged, simplified cross-section through the motor vehicle window pane of FIG. 1, with the associated body flange, the device of the invention being shown in the working position.
Figure 3:
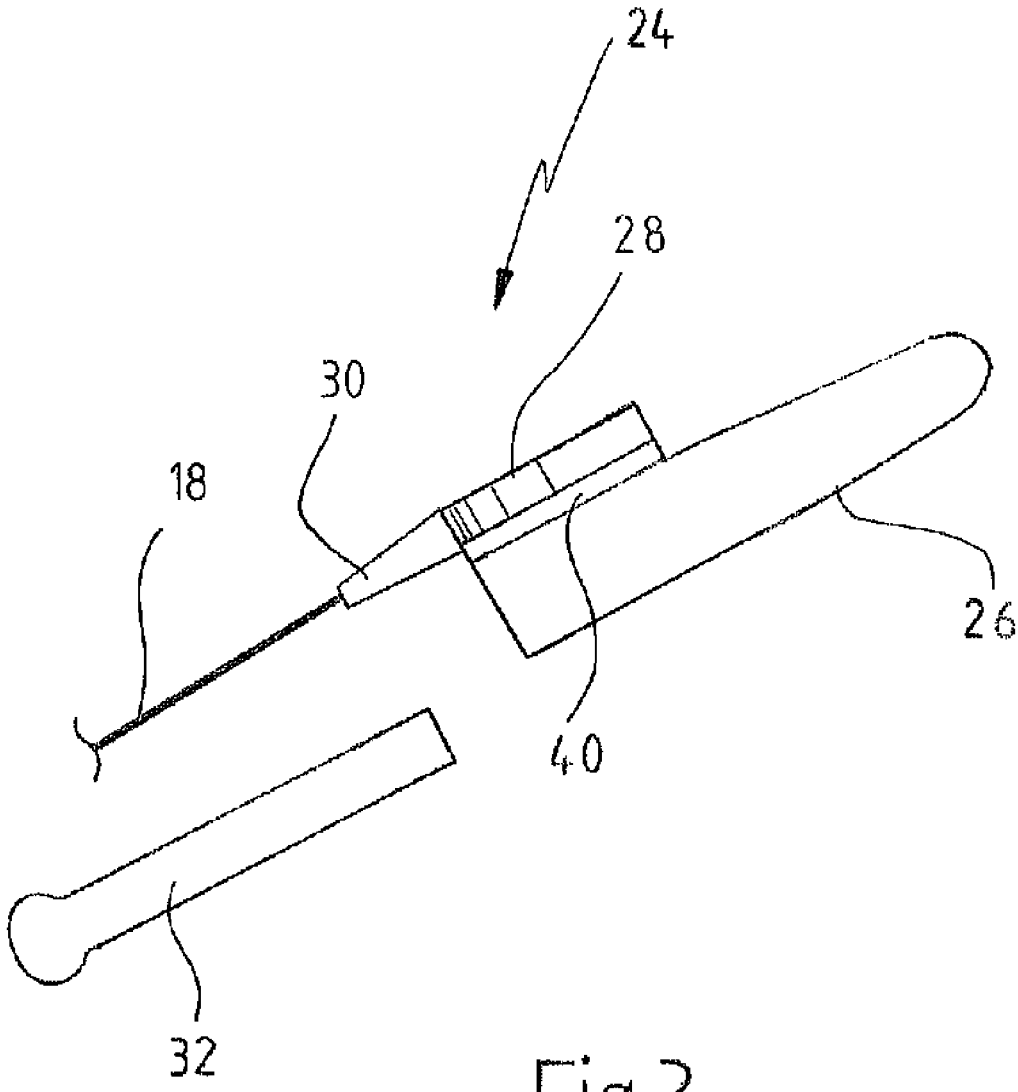
FIG. 3 is a further enlarged view of the device corresponding to FIG. 2, but showing the support detached from the device.

A windshield 12 is bonded to a body flange 14 by means of a bead of adhesive 34 (FIG. 2).

In order to replace windshield 12, for example after damage by stone chippings, a cutting wire 18 is used that is guided from the outside of the vehicle into gap 16 between motor vehicle window pane 12 and body flange 14, and guided completely around the entire bead of adhesive 34. One end of cutting wire 18 is fixed to the vehicle exterior. Any attachment point can be used for this purpose. For example, attaching it to the windshield wiper shaft 20 is particularly suitable.

A suitable fixing mechanism, for example a clamp 22, can be provided at the end of the cutting wire for attaching the end of the wire to the windshield wiper shaft 20.

Cutting wire 18, which is guided around the entire bead of adhesive 34, is inserted through the bead of adhesive 34 and guided to the vehicle interior 38. The end of cutting wire 18 is now attached to a winding device 24 disposed on the vehicle interior 38.

Winding device 24 has a reel 28 enclosed by a housing. A guide 30 is associated with reel 28, through which guide the cutting wire 18 is correctly guided onto reel 28 during a winding operation. A rod-shaped drive 26, comprising a suitable electric motor 25 and if necessary a transmission gear 27, is provided to drive winding device 24, and to which reel 28 is laterally flanged as shown in FIG. 2.

Drive 26 preferably has an electric motor 25 that is supplied with current from the mains supply or from an accumulator. However, the drive may also be driven by compressed air.

It is preferable that a slip clutch be provided between drive 26 and the reel 28 for winding; the clutch slips when a predefined torque is exceeded, with the result that the reel 28 does not continue winding in the event of overload. In FIG. 2, the slip clutch is only schematically indicated by reference numeral 40.

The bead of adhesive 34 can now be successively severed by operating the winding device 24. Cutting wire 18 is pulled bit by bit through the bead of adhesive 34 by winding it onto reel 28, thereby severing the bead of adhesive.

In order that the torque reaction does not have to be manually absorbed, the winding device 24 of the invention has a support 32 for supporting the device on the inside of the vehicle. Support 32 has a suitable shape and surface characteristics to enable appropriate support on the inside of the vehicle. Support 32 enables work to be carried out in an energy-saving manner, on the one hand, and support 32 serves, on the other hand, to protect fitted parts on the inside of the vehicle from being damaged, i.e. as protection for airbags, the dashboard, the roof lining, the interior linings, etc. The contact surface of support 32 can be suitably padded for this purpose, e.g. with rubber padding.

The cutting speed during window pane removal, which is predefined by the winding speed, is preferably in a range between about 3 and 12 m/min. To this end, the drive motor 25 can be fitted with an electronic, pushbutton-operated speed control unit 29, for example, so that the winding speed can be adjusted stepwise to the respective requirements during the window removal operation.

If, for whatever reason, cutting wire 18 is blocked during window removal, for example by becoming jammed, the slip clutch 40 is activated and prevents further winding of cutting wire 18 onto reel 28, thus preventing any overload.

Support 32 can preferably be replaced in order to allow adaptation to different vehicle interiors. If necessary, support 32 can also be configured to be pivotable by a certain amount relative to drive motor 26, as illustrated in FIG. 1, whereby it is possible for it to be locked into different angular positions 32 by means of a snap-in mechanism, for example. This enables further improvement in adapting the device to the respective geometric circumstances in a given vehicle.

What is claimed is:

1. A device for severing a bead of adhesive on a motor vehicle window pane, comprising:

a cutting wire having a first end and a second end;

a winding device comprising a motor and a reel;

said reel being configured for winding said cutting wire; said motor being configured for driving said reel;

a slip clutch being arranged between said motor and said reel, said slip clutch being configured for slipping when a predetermined torque is exceeded; and a support, said support comprised of an elongate longitudinal member longitudinally extending from a first end of the support in a direction substantially parallel to a length direction of the winding device, said support having a bulbous second end opposite the first end, said support being configured for movably supporting said winding device on an inner side of the vehicle at manually selected angles relative to said vehicle while manually guiding said winding device along said vehicle;

wherein the first end of the support is connected to the winding device, and wherein said first end of said cutting wire is attached to said reel which is configured for reeling in said cutting wire thereon.

2. The device of claim 1, wherein said second end of said cutting wire is attached to a fixture configured for securing said second end to an outside of said vehicle.

3. The device of claim 2, wherein said fixture is configured for clamping to a wiper driveshaft of a vehicle.

4. The device of claim 1, wherein said reel is externally encapsulated.

5. The device of claim 1, wherein said winding device comprises a guide for guiding said cutting wire to said reel.

6. The device of claim 1, further comprising a control unit for controlling the speed at which the cutting wire is wound up.

7. A device for severing a bead of adhesive on a motor vehicle window pane, comprising:

a cutting wire having a first end and a second end;

a winding device comprising a motor and a reel;

said reel being configured for winding said cutting wire; said motor being configured for driving said reel; and a support, said support comprised of an elongate longitudinal member longitudinally extending from a first end of the support in a direction substantially parallel to a length direction of the winding device, said support having a bulbous second end opposite the first end;

wherein the first end of the support is connected to the winding device, wherein said first end of said cutting wire is attached to said reel which is configured for reeling in said cutting wire thereon; and wherein said second end of said cutting wire is configured for being attached to an exterior of the vehicle.

8. The device of claim 7, comprising a control unit for controlling the speed at which the cutting wire is wound up.

9. The device of claim 7, further comprising a slip clutch driven by said motor and engaging said reel, said slip clutch is configured for slipping when a predetermined torque is exceeded.

10. The device of claim 7, wherein said winding device is configured for reeling in said cutting wire at a speed of 3 to 12 m/min.

11. The device of claim 7, wherein said winding device comprises a guide for guiding said cutting wire to said reel.

12. A device for severing a bead of adhesive on a motor vehicle window pane comprising:

a cutting wire having a first end and a second end;

a winding device comprising a motor and a reel;

said reel being configured for winding said cutting wire; said motor being configured for driving said reel;

a slip clutch being arranged between said motor and said reel, said slip clutch being configured for slipping when a predetermined torque is exceeded;

a support, said support comprised of an elongate longitudinal member longitudinally extending from a first end of the support in a direction substantially parallel to a length direction of the winding device, said support having a bulbous second end opposite the first end, said support being configured for movably supporting said winding device on an inner side of the vehicle at manually selected angles relative to said vehicle while manually guiding said winding device along said vehicle;

wherein the first end of the support is connected to the winding device, wherein said first end of said cutting wire is attached to said reel which is configured for reeling in said cutting wire thereon, and wherein said winding device is configured for reeling in said cutting wire at a speed of 1 to 20 m/min.

13. A device for severing a bead of adhesive on a motor vehicle window pane, comprising:

a cutting wire having a first end and a second end;

a winding device comprising a motor and a reel;

said reel being configured for winding said cutting wire;

said motor being configured for driving said reel;

a slip clutch being arranged between said motor and said reel, said slip clutch being configured for slipping when a predetermined torque is exceeded;

a support, said support comprised of an elongate longitudinal member longitudinally extending from a first end of the support in a direction substantially parallel to a length direction of the winding device, said support having a bulbous second end opposite the first end, said support being configured for movably supporting said winding device on an inner side of the vehicle at manually selected angles relative to said vehicle while manually guiding said winding device along said vehicle;

wherein the first end of the support is connected to the winding device, wherein said first end of said cutting wire is attached to said reel which is configured for reeling in said cutting wire thereon; and wherein said support is substantially parallel to said cutting wire and does not contact the cutting wire.

* * * * *